US006901718B2

(12) United States Patent
Osborne et al.

(10) Patent No.: US 6,901,718 B2
(45) Date of Patent: Jun. 7, 2005

(54) PAPER PACKAGING APPARATUS

(75) Inventors: Celeste Osborne, Lewiston, ID (US); Mike Ellis, Lewiston, ID (US); Mike Ruark, Clarkston, WA (US)

(73) Assignee: Potlatch Corporation, Spokane, WA (US)

( * ) Notice: Subject to any disclaimer, the term of this patent is extended or adjusted under 35 U.S.C. 154(b) by 0 days.

(21) Appl. No.: 10/759,758

(22) Filed: Jan. 14, 2004

(65) Prior Publication Data

US 2004/0144062 A1 Jul. 29, 2004

Related U.S. Application Data

(62) Division of application No. 10/202,554, filed on Jul. 23, 2002, now Pat. No. 6,732,492.

(51) Int. Cl.[7] ..... B65B 63/02; B65B 63/04

(52) U.S. Cl. ..... 53/117; 53/529; 493/437

(58) Field of Search ..... 53/117, 429, 438, 53/439, 529, 537; 493/437

(56) References Cited

U.S. PATENT DOCUMENTS

| | | | | | |
|---|---|---|---|---|---|
| 3,234,072 | A | * | 2/1966 | Dreeben | 156/498 |
| 3,626,844 | A | * | 12/1971 | Priesmeyer | 101/31.1 |
| 3,656,271 | A | * | 4/1972 | O'Shea et al. | 53/429 |
| 3,919,827 | A | | 11/1975 | Larson et al. | |
| 4,204,468 | A | * | 5/1980 | Harrison | 101/31.1 |
| 4,472,923 | A | | 9/1984 | Herrington | |
| 4,751,807 | A | * | 6/1988 | Couturier | 53/429 |
| 4,761,197 | A | * | 8/1988 | Christine et al. | 156/290 |
| 4,949,846 | A | * | 8/1990 | Lakey | 206/484 |
| 5,185,987 | A | | 2/1993 | Turvey et al. | |
| 5,299,793 | A | * | 4/1994 | Couturier | 270/39.06 |
| 5,375,393 | A | * | 12/1994 | Baker et al. | 53/429 |
| 5,406,774 | A | | 4/1995 | Dodge | |
| 5,422,083 | A | | 6/1995 | Sheller | |
| 5,493,846 | A | | 2/1996 | Baker et al. | |
| 5,673,538 | A | | 10/1997 | Wallace et al. | |
| 5,800,766 | A | | 9/1998 | Merry | |
| 5,937,615 | A | * | 8/1999 | Forman | 53/133.4 |
| 6,035,605 | A | | 3/2000 | Perego | |
| 6,182,418 | B1 | | 2/2001 | McFarland | |
| 6,202,392 | B1 | | 3/2001 | Greenwell et al. | |
| 6,233,905 | B1 | * | 5/2001 | Singh | 53/381.1 |
| 6,305,146 | B1 | | 10/2001 | Gerber | |
| 6,349,525 | B1 | | 2/2002 | Veith | |

FOREIGN PATENT DOCUMENTS

| | | | | |
|---|---|---|---|---|
| DE | 35 37 736 | * | 5/1986 | B31F/1/07 |

* cited by examiner

*Primary Examiner*—Scott A. Smith
*Assistant Examiner*—Gloria R. Weeks
(74) *Attorney, Agent, or Firm*—Wells St. John P.S.

(57) ABSTRACT

The invention includes a method of packaging paper products (such as facial tissue) in a dispenser. A clip of paper product is folded. The folded clip has a central region and a pair of opposing peripheral regions separated from one another by the central region. The peripheral regions of the folded clip are pressed toward one another to compress the peripheral regions. After the peripheral regions are compressed, the folded clip is transferred into the dispenser.

18 Claims, 5 Drawing Sheets

PAPER PACKAGING APPARATUS

CROSS REFERENCE TO RELATED APPLICATION

This application is a divisional of U.S. patent application Ser. No. 10/202,554, which was filed on Jul. 23, 2002, now U.S. Pat. No. 6,732,492 and which is incorporated by reference herein.

TECHNICAL FIELD

The invention pertains to methods of packaging paper products, and in particular applications pertains to methods of packaging facial tissue in a dispenser.

BACKGROUND OF THE INVENTION

A method of packaging paper products, such as facial tissue, which has gained acceptance in the marketplace is to fold a stack of paper product sheets about a central axis and then provide the sheets within a boutique-type box. The box has a perforation extending therethrough to the central region of the folded sheets, and such allows a consumer to withdraw the sheets from the box. The packaging can have an advantage in that the box of folded paper product can have a smaller footprint that would a box of non-folded paper product. Also, in many cases consumers associate a box of folded paper product with a premium line of product, rather than with lower-tier product. Examples of facial tissue products marketed in boutique-type boxes are ALBERTSON'S™ "WHISPER SOFT IMAGES"™; HYVEE™ "SOFT ESSENTIALS TREASURES"™; and KLEENEX™ "ULTRA SOFT DOUX"™.

The box having the folded tissue therein is a dispenser. Ideally, the tissue will be dispensed one-at-a-time through the perforation which extends into the box. However, it is frequently found that the first several sheets do not dispense smoothly in a one-at-a-time manner. Instead the sheets bind within the box and either tear as they are being pulled from the box, or come out as a clump of four or five tissues. Since the tissues within a boutique-type dispenser are associated with premium product, there can be heightened consumer dissatisfaction with the poor dispensing of the first few sheets than would occur with packaging not associated with premium product.

The problem of having the first few sheets dispensed poorly from a boutique-type dispenser has existed for years, and to date there has not been a satisfactory solution to the problem. A recent study by Potlatch Corporation has shown that there are times when at least sixty percent of the boutique-type dispensers produced for a line of premium paper product will fail to appropriately dispense the first sheet of product, and there can even be times when eighty percent or more of the packages fail to appropriately dispense the first sheet of tissue product.

FIGS. 1–3 illustrate an exemplary process for providing facial tissue within a boutique-type box. Referring initially to FIG. 1, an arrangement 8 is shown comprising a clip 10 of facial product folded around a ski 14. The clip comprises a plurality of individual tissue sheets 12 (only some of which are labeled). The term "clip" is known in the art to refer to a stacked plurality of sheets which have been appropriately sized to be provided within a package.

The ski 14 has an edge 16, and opposing lateral surfaces 18 extending upwardly from the edge. The clip 10 comprises a central region 20 proximate the edge 16 of ski 14. Clip 10 further comprises peripheral regions 22 and 24 on opposing sides of central region 20, with the peripheral regions extending along lateral edges 18 of ski 14 in the shown folded configuration of the clip.

Clip 10 would be folded about ski 14 utilizing an apparatus (not shown) which forces peripheral regions 22 and 24 upwardly relative to central region 20 of the clip.

FIGS. 2 and 3 illustrate an apparatus 30 comprising the clip and ski arrangement 8, and further comprising a holder 32 configured to retain a package 34 thereon. Package 34 can correspond to a boutique-type dispenser. In the shown configuration, a perforation (not visible in FIGS. 2–4) would be at a bottom surface 36 of dispenser 34, and ultimately a consumer would remove tissue of clip 10 from dispenser 34 through the perforation. Dispenser 34 has a series of flaps 38, 40 and 42 associated therewith, and such flaps surround an opening (not visible in the views of FIGS. 2 and 3).

The ski 14 of FIGS. 2 and 3 extends along a longitudinal direction 15, and comprises a length 17. In operation, the folded clip 10 is slid along a portion of length 17 of ski 14, and ultimately is slid off from ski 14 and along an axis 44 into the opening within dispenser 34. FIG. 2 shows the clip at a processing stage at which the clip is along the ski, and FIG. 3 shows the clip at a processing stage after it has been slid off from the ski and into the dispenser. The clip 10 of FIG. 3 is shown in phantom view to indicate that the clip is within dispenser 34. It is noted that clip 10 is generally moved from the ski to the dispenser by a conveying mechanism (not shown) such as a block or plurality of fingers configured to engage a surface of the clip and push the clip along the axis 44.

FIG. 3 illustrates that the flaps 38, 40 and 42 (FIG. 2) have been folded over to retain clip 10 within package 34.

SUMMARY OF THE INVENTION

In one aspect, the invention encompasses a method of packaging paper products in a dispenser. A clip comprising a stacked plurality of paper products is provided. Also, a ski is provided. The ski comprises a first surface extending longitudinally along the first direction, and has a pair of second surfaces extending transversely from the first surface. The clip is folded around the ski. The folded clip has a central region along the first surface of the ski, and has a pair of opposing peripheral regions separated from one another by the central region. The folded clip is slid off from the ski and subsequently the peripheral regions of the folded clip are pressed toward one another to compress the peripheral regions. After the peripheral regions are compressed, the folded clip is transferred into the dispenser. The peripheral regions can be subjected to at least about 1 pound per square inch gauge (psig) of pressure during the pressing.

In further aspects, the invention encompasses methods of packaging facial tissue.

BRIEF DESCRIPTION OF THE DRAWINGS

Preferred embodiments of the invention are described below with reference to the following accompanying drawings.

FIG. 7 is a diagrammatic side view of an exemplary ski which can be utilized in methodology of the present invention.

FIG. 8 is a diagrammatic end view of the FIG. 7 ski, along the line 8 of FIG. 7.

DETAILED DESCRIPTION OF THE PREFERRED EMBODIMENTS

One aspect of the invention is a recognition that a reason the first few sheets of tissues are difficult to remove from a boutique-type box can be that the first few sheets are tightly pushed against the interior sides of the boutique-type box, and accordingly friction makes it difficult to withdraw the first few sheets. Once the first few sheets have been removed, the remaining sheets can be more easily withdrawn because the pressure between the remaining sheets of the clip and the interior sidewall of the box decreases as sheets are removed and the bulk of the remaining clip is thereby reduced.

Various methods have been investigated for reducing the overall bulk of a folded clip within a boutique-type box in an effort to reduce the friction of the outermost sheets of the clip relative to an interior surface of the box. Among such methods are to increase the dimensions of the box, or decrease the number of sheets in a clip. Neither method is considered satisfactory. If the dimensions of the box are increased, then the footprint of the box will increase which means that less boxes can be included on the same amount of shelf space as are presently being provided. Also, an increase in the dimensions of a boutique-type box would create complications in the transport and distribution of the boxes. A reduction in the total number of sheets contained within a box can create problems with consumer perception of the quality of the package. Specifically, each box of tissue is generally prominently labeled with the number of sheets in the box. Consumers would likely be dissatisfied if the number of sheets in boxes of premium tissue were suddenly reduced, even if such translated into better dispensing of the first of the remaining sheets from the box.

Figure 1:
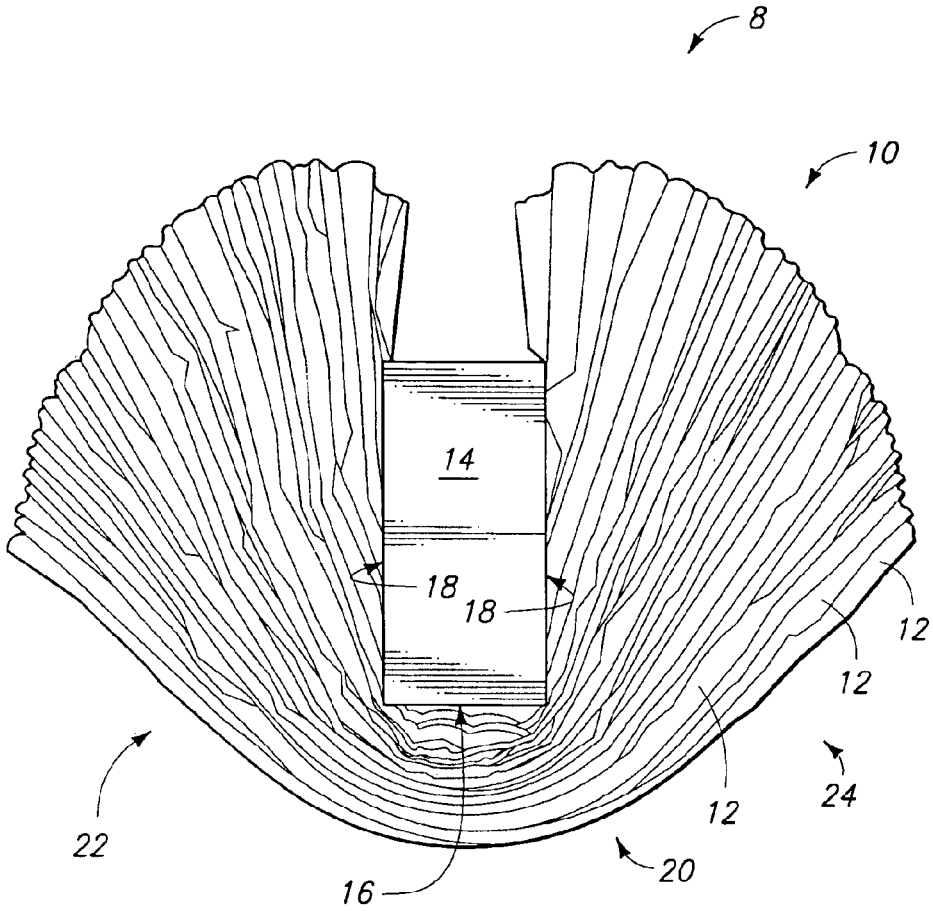
FIG 1 PRIOR ART
FIG. 1 is a diagrammatic end-view of a prior art arrangement comprising a clip of paper product sheets folded around a ski.
Figures 2, 3, 4:
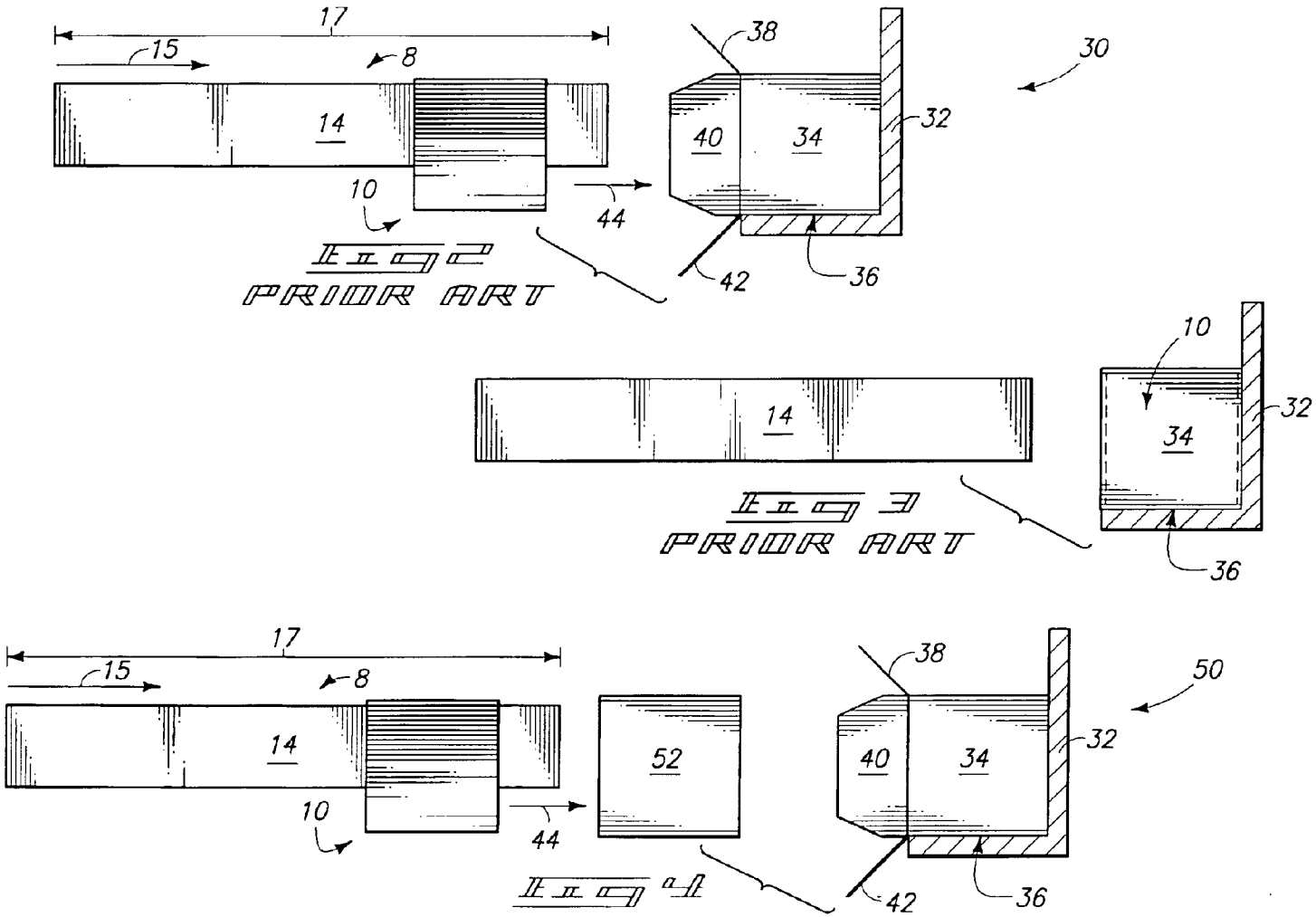
FIG 2 PRIOR ART
FIG 3 PRIOR ART
FIG. 2 is a diagrammatic side view of a prior art apparatus utilized for inserting a folded clip of paper product into a package.
FIG. 3 is a view of the prior art apparatus of FIG. 2 shown at a processing stage subsequent to that of FIG. 2.
FIG. 4 is a diagrammatic side view of an apparatus utilized for inserting a folded clip of paper product into a package in accordance with an aspect of the present invention.

FIG. 4 shows an apparatus 50 which can be utilized in various aspects of the present invention. Similar numbering will be utilized in referring to FIG. 4 as was used above in referring to FIGS. 2 and 3, where appropriate. The apparatus of FIG. 4 is similar to that of FIGS. 2 and 3, except that a compression unit 52 is provided between ski 14 and dispenser 34. In operation, folded clip 10 is slid off from ski 14 and into the compression unit, squeezed by the compression unit, and then transferred into dispenser 34. The squeezing of clip 10 by the compression unit prior to insertion of the clip into the dispenser is found to reduce friction of peripheral edges of the clip relative to internal sidewalls of the dispenser, and to thus improve dispensing of the first few sheets of the clip from the dispenser.

Figure 5:
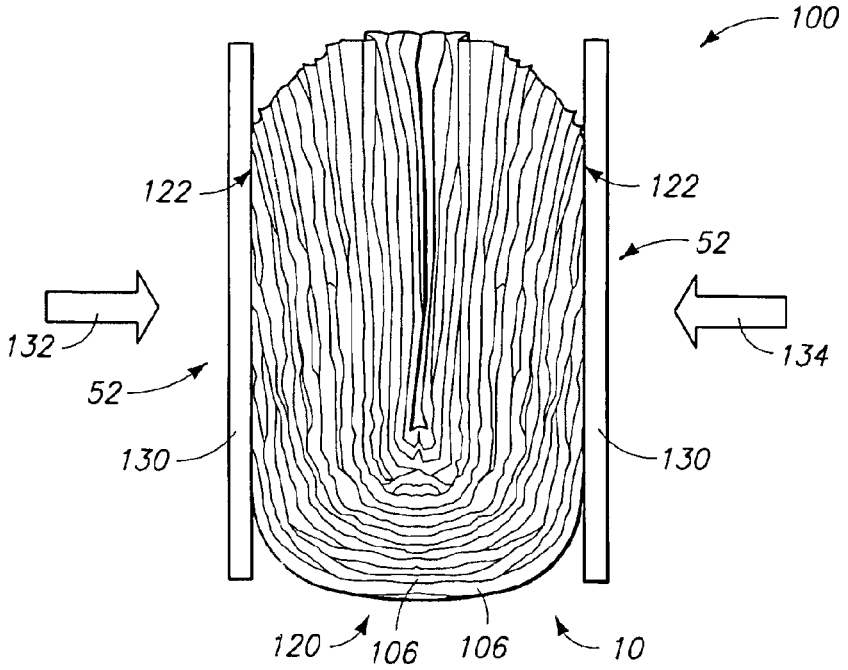
FIG. 5 is a diagrammatic end-view of an arrangement comprising a folded clip of paper product in accordance with an exemplary method of the present invention.

FIG. 5 illustrates operation of the compression unit 52 for reducing the bulk associated with a folded clip prior. More specifically, FIG. 5 shows an arrangement 100 comprising the clip 10 folded and compressed within compression unit 52. Clip 10 comprises a stacked plurality of paper products 106 (only some of the individual paper products are labeled). The paper products can correspond to, for example, facial tissue.

Clip 10 comprises a central region 120 and comprises a pair of opposing peripheral regions 122 separated from one another by the central region. In the shown aspect of the invention, clip 10 is folded approximately in half. Accordingly, peripheral regions 122 correspond to folded regions separated from one another by the fold and each comprising about one-half of the total clip.

Compression unit 52 comprises a pair of plates 130 which press against the peripheral regions 122 of clip 10. A compressive force applied to plates 130 is illustrated diagrammatically by arrows 132 and 134. The force against the plates can be generated utilizing, for example, one or more of electric, hydraulic or pneumatic power sources. Preferably, peripheral regions 122 are subjected to at least about 1 pound per square inch gauge (psig) of pressure during the compression of the peripheral regions with plates 130. In particular applications, the pressure can be at least about 5 psig, and least about 10 psig, and at least about 15 psig. In some applications, the pressure can be greater than or equal to about 15 psig, and less than or equal to about 400 psig.

It is found that if too much pressure is applied, desirable qualities of the individual sheets can be compromised, and even lost. Also, it is found that if too little pressure is applied, the bulk of the peripheral regions of the clip is not sufficiently reduced to avoid the problems associated with withdrawal of the first few sheets of the clips that were discussed above with reference to the prior art. It can be desired to apply from at least about 10 psig of pressure to less than or equal to about 100 psig of pressure to peripheral regions 122, and even more desired to apply from at least about 20 psig of pressure to less than or equal to about 80 psig of pressure to peripheral regions 122. In exemplary applications, about 50 psig of pressure is applied to peripheral regions 122, and in other applications about 80 psig of pressure is applied to peripheral regions 122.

The pressure at peripheral regions 122 can be applied for a time of less than or equal to about 10 seconds (such as a time of from about 1 second to about 10 seconds, or a time of less than or equal to about 5 seconds), and can be applied at typical operating temperatures utilized in paper production factories, such as, for example, temperature of from greater than 0° C. to less than or equal to about 40° C.

After the compression described with reference to FIG. 5, the clip 10 can be slid into a package utilizing processing analogous to that described above with reference to prior art FIGS. 2 and 3. Specifically, plates 130 are withdrawn from peripheral surfaces 122 of clip 10, and the clip is subsequently slid into a package.

Figure 9:
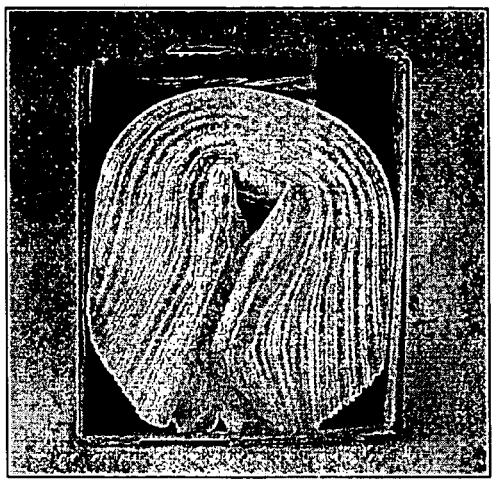
Fig 9 PRIOR ART
FIG. 9 is a black and white photograph showing a prior art assembly comprising a boutique-type package having a folded clip retained therein.
Figure 10:
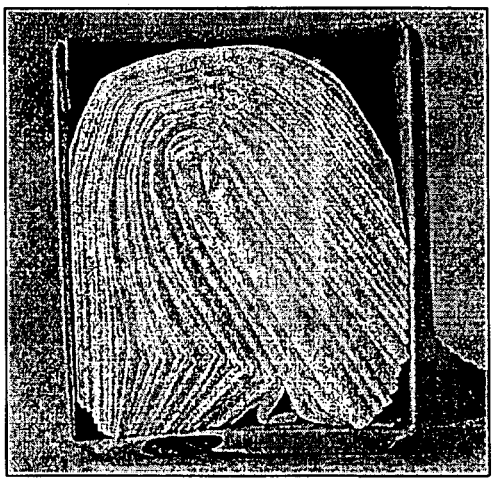
FIG. 10 is a black and white photograph of an assembly comprising a folded clip within a boutique-type package and formed in accordance with an aspect of the present invention.
Figure 11:
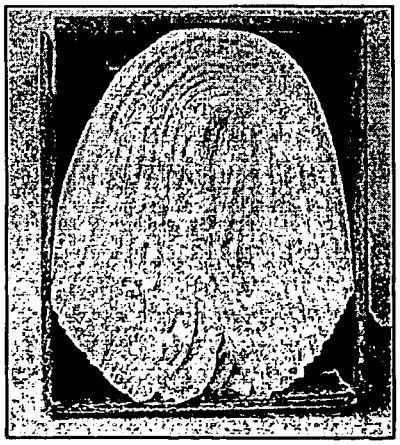

Although the clip is typically slid off from the ski prior to the compression of the peripheral regions of the clip, the ski shape can still influence physical properties of the compressed clip. It is found that it can be advantageous to utilize a narrow ski, rather than a wide ski, in various methods of the present invention. However, a problem which can occur when a narrow ski is utilized is that the clip can rotate relative to the ski so that the clip is skewed in its ultimate orientation within a package. Such is illustrated in FIGS. 9 and 10. Specifically, FIG. 9 shows a prior art package comprising a folded clip of facial tissue within a boutique-type box. A side of the box has been opened so that the clip can be seen in its ultimate orientation within the box. A perforation (not clearly visible in the view of FIG. 9) is at the top of the box, and in operation a consumer would reach through the perforation to pull a sheet of facial tissue from the folded clip. Ideally, the folded clip would be oriented in the box such that a highest point of the clip is directly under the perforation at the top of the box, and so that each of the peripheral sides of the clip would have approximately the same pressure against an interior side of the box as one another. The shown prior art clip of FIG. 9 is slightly skewed in the box, but the orientation is reasonable in that both sides of the clip have about the same amount of overlap with interior sides of the box. It is noted that the folded clip of FIG. 9 has a relatively wide hole in the middle, evidencing that the ski utilized to insert the clip into the package was relatively wide.

FIG. 10 illustrates a clip formed around a narrow ski prior to being inserted into the package. Note that the central region of the clip does not have the wide gap of the FIG. 9 clip, which evidences that the FIG. 10 folded clip came off of a narrower ski than did the FIG. 9 folded clip. The FIG. 10 clip is skewed significantly more than the FIG. 9 clip, as evidenced by the fact that the shown left side of the clip rubs against an interior side of the package whereas the shown right side of the clip does not even contact the interior right side of the box. The excessive skew of the FIG. 10 clip is undesired. The excessive skew can cause tissue to pull unevenly from the clip due to the significantly increased friction along the left side of the clip relative to the right side. As the tissue pulls unevenly from the clip, clumping of remaining tissue within the FIG. 10 package can occur, which can lead to tearing of the sheets as a consumer attempts to withdraw the clump, and/or to multiple sheets coming out simultaneously.

Figure 11:
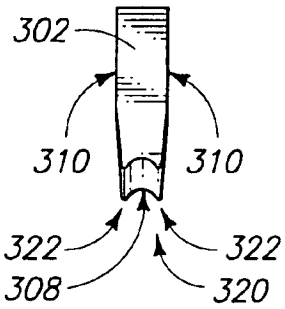
FIG. 11 is black and white photograph of an assembly comprising a folded clip retained within a boutique-type package and formed in accordance with another aspect of the present invention.
Figure 12:
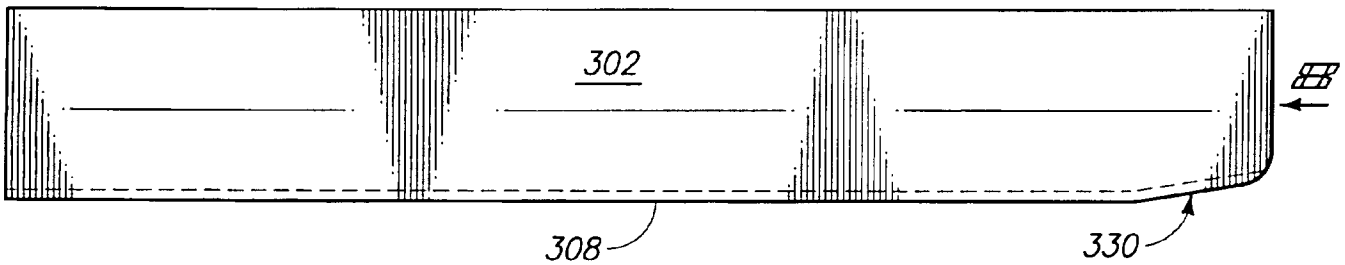

FIG. 11 illustrates a folded clip that has been formed around a narrow ski and subsequently inserted into a package in a desired configuration. Specifically, a top surface of the clip is directly under a perforation (not visible in the view of FIG. 11) at the top of the package, and the clip is symmetric so that the left and right sides of the clip rub about equally on interior sidewalls of the package.

It is desired to increase the number of packages having the desired configuration of FIG. 11 relative to the packages having the undesired configuration of FIG. 10. The FIG. 10 problems and FIG. 11 advantages can occur regardless of whether the compression unit 52 of FIGS. 4 and 5 is present. If the compression unit is not present and the clip is transferred directly from the ski into the dispenser, poor orientation of the clip from the ski will typically be directly translated into a poor orientation of the clip in the dispenser. If the clip is transferred from the ski to the compression unit, poor orientation of the clip from the ski can lead to compression of the clip along an undesired axis and a resulting poor fold orientation. The poor fold orientation can then translate into a poor orientation of the clip in the dispenser.

Figure 6:
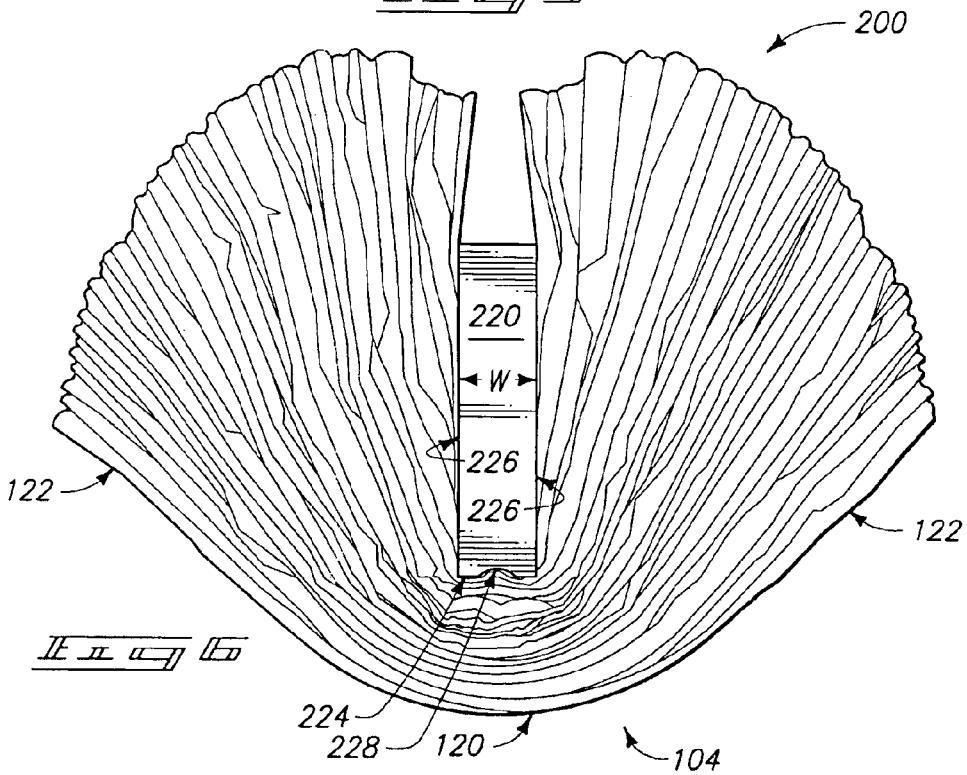
FIG. 6 is a diagrammatic end-view of an arrangement comprising a folded clip of paper product around a ski in accordance with an exemplary method of the present invention.

FIG. 6 illustrates one method for enhancing control of the orientation of a clip as it is slid off from a ski. In referring to FIG. 6, similar number will be utilized as was used above in describing FIGS. 2–5, where appropriate. FIG. 6 illustrates an assembly 200 comprising clip 10 folded around a ski 220. Ski 220 has a different shape than conventional skis. Ski 220 comprises an edge 224 between a pair of laterally-extending surfaces 226. A notch (or cavity) 228 extends into edge 224. Notch 228 can extend, for example, at least about ¼ inch or at least about ½ inch into the edge. In the shown embodiment, edge 224 comprises a width "W", and notch 228 is approximately centered relative to the width. Ski 220 typically extends longitudinally analogously to the ski 14 of FIG. 2. Further, ski 220 will comprise a longitudinal length, analogous to the length 17 of prior art ski 14. In particular embodiments, notch 228 can extend along at least a portion of length of the ski. In some aspects the notch can extend along at least a fourth of the length of the ski and in further aspects can extend along an entirety of the length of the ski.

Notch 228 can assist in retaining clip 104 in a particular orientation relative to ski 220. Specifically, notch 228 provides additional surfaces for retaining clip 104 as the clip is slid off from ski 220 and into a package. Accordingly, notch 228 can assist in reproducibly and consistently orienting clips of stacked tissue in a desired configuration within a dispenser. Such can enable the desired FIG. 9 configuration of a package, for example, to be reproducibly obtained.

FIGS. 7 and 8 illustrate an exemplary ski 302 that can be utilized in methodology of the present invention. Ski 302 comprises a first (or bottom) surface 308 extending longitudinally along a first direction (with the longitudinal direction of the ski being analogous to the direction 15 of FIG. 2). Ski 302 further comprises a pair of second surfaces 310 which extend upwardly relative to first surface 308. In particular applications, surface 308 can be referred to as an edge, and surfaces 310 can be referred to as opposing lateral surfaces extending from the edge. Ski 302 can be referred to generically as a bar.

Ski 302 can have an edge width of less than or equal to about one inch, less than or equal to about ¾ inch, and in particular applications can have a width of less than or equal to about one-half inch.

The edge 308 of ski 302 is illustrated as being curved upwardly between lateral surfaces 310 to form a cavity 320. Cavity 320 can have a depth of about ⅛ inch. Corners 322 are formed where edge 308 joins surfaces 310, and such corners can aid in retaining and orienting a clip folded around the lower portion of ski 302.

Ski 302 has a ramped portion 330 of the lower surface, which can extend at, for example, about a 9° angle relative to the non-ramped portion of the lower surface. The ramped portion can aid in releasing a folded clip from the ski.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A paper packaging apparatus comprising:

a paper package holder configured to retain a package thereon during insertion of a clip of paper into the package; and a paper packaging ski configured to insert the clip of paper into the package, the ski comprising:

an edge extending longitudinally from a tip of the ski;

a pair of opposing lateral surfaces extending from the edge, the edge and lateral surfaces being configured to support the clip of paper; and a notch extending laterally into the edge.

2. The apparatus of claim 1 further comprising a compression unit operatively aligned between the paper package holder and the paper packaging ski, the compression unit configured to compress the clip of paper prior to insertion of the clip of paper into the package.

3. The apparatus of claim 1 wherein the notch extends longitudinally along the edge from the tip of the ski.

4. The apparatus of claim 1 wherein the notch extends at least ¼ inch into the edge.

5. The apparatus of claim 1 wherein the notch extends at least ½ inch into the edge.

6. The apparatus of claim 1 wherein the edge comprises a ramped portion which extends at an angle relative to another portion of the edge.

7. The apparatus of claim 6 wherein the ramped portion extends from the tip of the ski.

8. The apparatus of claim 6 wherein the ramped portion extends at a 9 degree angle relative to the another portion of the edge.

9. The apparatus of claim 1 wherein the clip of paper comprises facial tissue.

10. The apparatus of claim 1 wherein the edge comprises a width and the notch is approximately centered relative to the width.

11. The apparatus of claim 1 wherein the notch extends the entire length of the edge of the ski.

12. The apparatus of claim 1 wherein the package comprises a boutique-type box.

13. A paper packaging apparatus comprising:

a paper package holder configured to retain a facial tissue package thereon during insertion of a clip of facial tissue into the package; and a compression unit operatively aligned with the paper package holder, the compression unit configured to compress the clip of facial tissue prior to insertion of the clip of facial tissue into the package.

14. The apparatus of claim 13 wherein the paper package comprises a boutique-type box.

15. The apparatus of claim 13 wherein the compression unit comprises a pair of plates configured to press against the peripheral regions of the clip of facial tissue.

16. The apparatus of claim 13 further comprising a bar operatively aligned with the compression unit and configured to insert the clip of facial tissue into the facial tissue package.

17. The apparatus of claim 16 wherein the bar comprises:

a first surface extending longitudinally along a first direction;

a pair of second surfaces extending upwardly from the first surface, the second surfaces laterally opposing one another; and wherein the first surface is curved upwardly between the pair of second surfaces.

18. The apparatus of claim 17 wherein the bar further comprises a pair of corners, each of the pair of corners being formed at the point where each of the pair of second surfaces extend upwardly from the first surface.

* * * * *